US008220081B2

(12) United States Patent
Vlemmings

(10) Patent No.: US 8,220,081 B2
(45) Date of Patent: Jul. 17, 2012

(54) COVER ELEMENT FOR TEMPORARILY COVERING A URINAL

(75) Inventor: Levi Vlemmings, Helmond (NL)

(73) Assignee: Attention Reclame, Helmond (NL)

( * ) Notice: Subject to any disclaimer, the term of this patent is extended or adjusted under 35 U.S.C. 154(b) by 331 days.

(21) Appl. No.: 12/537,054

(22) Filed: Aug. 6, 2009

(65) Prior Publication Data

US 2010/0037377 A1 Feb. 18, 2010

(30) Foreign Application Priority Data

Aug. 12, 2008 (NL) ..... 1035812

(51) Int. Cl.
*A47K 13/00* (2006.01)

(52) U.S. Cl. ..... 4/253

(58) Field of Classification Search ..... 4/253, 245.1, 4/144.1, 661, 310, 309, 301, 454–455, 300.3, 4/234, 239; 5/604; 604/349; D23/310
See application file for complete search history.

(56) References Cited

U.S. PATENT DOCUMENTS

| | | | | |
|---|---|---|---|---|
| 134,315 | A * | 12/1872 | Robinson | 4/301 |
| 487,130 | A | 11/1892 | Schoen | 4/309 |
| 4,531,245 | A * | 7/1985 | Lowd et al. | 4/144.3 |
| 4,571,759 | A * | 2/1986 | Sasaki et al. | 5/604 |
| 5,564,135 | A * | 10/1996 | Jones et al. | 4/300.3 |
| 5,590,426 | A * | 1/1997 | Moffre et al. | 4/301 |
| 6,286,153 | B1 * | 9/2001 | Keller | 4/301 |
| 6,406,463 | B1 * | 6/2002 | Brown | 604/349 |
| 7,412,732 | B1 * | 8/2008 | Leonard | 4/300.3 |
| 7,461,411 | B2 * | 12/2008 | Wolf | 4/239 |
| 7,797,767 | B2 * | 9/2010 | Benkhardt et al. | 4/234 |
| 2004/0098795 | A1 * | 5/2004 | Benkhardt et al. | 4/234 |
| 2004/0139535 | A1 * | 7/2004 | Vandersand | 4/310 |
| 2005/0193482 | A1 * | 9/2005 | Gambla et al. | 4/300.3 |
| 2007/0266493 | A1 * | 11/2007 | Jimenez | 4/661 |

FOREIGN PATENT DOCUMENTS

| | | |
|---|---|---|
| WO | WO2006/043042 | 4/2006 |

* cited by examiner

*Primary Examiner* — Lori Baker
(74) *Attorney, Agent, or Firm* — Roberts & Roberts, LLP

(57) ABSTRACT

A cover element for preventing the use of certain urinals, such as those which are out of use. The cover element temporarily covers an open area of a urinal bounded by a urinal edge, which area is accessible to a user. The dimension of the cover element is at least such that substantially the entire open area of the urinal can be covered therewith. The cover element has at least two lips which can be moved against a spring force from a first position to a second secured position, such that the lips are positioned in clamping contact against an inner side of the urinal edge. This serves to attach the cover element over the open area of the urinal.

4 Claims, 2 Drawing Sheets

COVER ELEMENT FOR TEMPORARILY COVERING A URINAL

BACKGROUND OF THE INVENTION

Field of the Invention

The invention relates to a cover element for temporarily covering an open area of a urinal bounded by a urinal edge, which area is accessible to a user, the dimension of the cover element being at least such that substantially the entire open area of the urinal can be covered therewith.

Urinals are mostly installed in rows in rest rooms. It is a common occurrence that urinals get clogged with waste, such as cigarette butts. To prevent further (water) nuisance, a clogged urinal must be put out of use. Putting the urinal out of use temporarily is normally done by means of a trash bag serving as a cover element, which is placed over the urinal.

To visitors of the rest room it is apparent upon entering the rest room, on account of the presence of the trash bag placed over the urinal, that the urinal in question is temporarily out of use and must not be used.

A problem connected to the use of trash bags is that they are comparatively difficult to arrange over urinals, because in order to obtain a proper covering also string and/or tape is required for attaching the bag to or around the urinal. Another thing is that fixing a trash bag to or around a defective urinal by means of string and/or tape is not a pleasant activity.

Moreover, unlike toilets, which are often separated from the rest of the rest room by a door that can be closed, such urinals covered with trash bags remain quite visible in the rest room, which does not enhance the appearance of the rest room at all.

SUMMARY OF THE INVENTION

It is an object of the invention to provide a cover element which can be attached to the urinal in a simple manner.

This object is accomplished with the cover element according to the invention in that the cover element is provided with means of attachment which can be clamped against the urinal edge for attaching the cover element over the open area of the urinal.

The cover element according to the invention is provided with its own means of attachment connected thereto for attaching the cover element to a urinal. The cover element can be attached to the urinal in a relatively quick and simple manner by means of the means of attachment by making use of the urinal edge that defines the open area of the urinal, against which urinal edge the means of attachment are clamped. By covering this open area substantially entirely, preferably entirely, by means of the cover element according to the invention, it is made clear to visitors that the urinal is temporarily out of use.

Another advantage of the cover element according to the invention is that by positioning the means of attachment against the urinal edge, the means of attachment themselves are also largely, if not completely, hidden from view to visitors of the rest room, since the means of attachment are positioned in the open area against the urinal edge, which open area is practically entirely covered by means of the cover element.

The cover element is preferably made of a relatively rigid layer of plastic, so that the urinal that has been temporarily put out of use will look relatively taut and well cared-for, in particular in comparison with the creased trash bag that is normally used for temporarily putting a urinal out of use.

An advantageous embodiment of the cover element according to the present invention is characterised in that the means of attachment comprise at least two lips which can be moved against spring force from a first position substantially parallel to a covering surface of the cover element to a second attached position in which the lips are positioned in clamping contact with the urinal edge.

To use the cover element according to the invention, at least two lips are moved against spring force from a first position substantially parallel to a covering surface of the cover element to a second fixed position. In the second fixed position, the lips tend to spring back to the first position. By positioning at least two opposite lips against or behind the urinal edge, the cover element according to the invention is clamped down to the urinal.

Instead of two opposite lips, three or four or even more lips may be provided. When three lips are used, the position of the lips on the cover element is preferably selected so that the angle between two of the three lips is about 120 degrees.

The cover element according to the invention is preferably a flat layer, preferably made of plastic material. In such a cover element, the lips are preferably scored or cut, and the lips can be pushed out from the flat surface from the first position and be placed against the urinal edge. The material of the cover element is preferably selected so that the lips tend to return to the first position from the second position under the influence of the spring force. Any material that comprises this property is suitable for the cover element according to the invention. The cover element is preferably made of a relatively inexpensive plastic that has the aforesaid property. An advantage of an inexpensive plastic is that the cover element is suitable for single use. In principle, the lips can also be cut into the cover element (prior to use on a urinal. According to a more user-friendly possibility, however, the lips are formed in the cover element at the works.

A flat cover element comprising a single layer furthermore provides a cover element which is easy to store and which, on account of its flat configuration, will take up relatively little space even when stored in large numbers.

In another flat single-layer variant of the cover element, the lips may be formed by at least two opposite ends of the cover element. By folding the ends of the cover element forming the lips about a fold line against spring force, such a cover element can be attached to a urinal by clamping the ends forming the lips against or behind a urinal edge.

The lips located on one of the two sides of the cover element may extend in a direction facing the open area in any position, i.e. clamped and unclamped, so that the lips will make an angle with the covering surface in any position instead of lying parallel to the covering surface in the first position. The lips may be glued to the covering surface or be otherwise attached thereto. Such lips are likewise moved against spring force from a first position to a second secured position.

In a special preferred embodiment of the cover element according to the invention the length of a lip is variable.

Varying the length makes it possible to adapt the cover element to urinals of varying dimension, so that a universal cover element can be produced which will fit over practically any urinal.

Normally, the length of the lips can be selected by selecting the fold line, i.e. in the case of a relatively small urinal the fold line will be located more towards the centre of the universal cover element than in the case of a relatively large urinal.

In another variant, the means of attachment may comprise at least two projections extending transversely to the cover element, by means of which projections a cover element can be clamped between two opposite sides of the urinal edge.

Making use of the spring force of the cover element makes it possible to use at least two fixed projections instead of lips on one of the two sides of the cover element that will face the open area for attaching the cover element to the urinal. By slightly bending the cover element, which is not attached to the urinal yet, prior to attaching it to the urinal, the spacing between said at least two projections is changed, as a result of which the projections are positioned between two opposite sides of the urinal edge, with the original spacing between the projections being restored when the cover element is released and the cover element being clamped down to the urinal edge.

The invention will be described in more detail hereinafter by means of an embodiment which is also shown in the appended figures. The illustrated embodiment is an example of an embodiment, as it will be apparent from the foregoing and from the claims that various modifications to the embodiments as shown and discussed are possible.

BRIEF DESCRIPTION OF THE DRAWINGS

Like parts are provided with the same numerals in the figures.

DETAILED DESCRIPTION OF THE INVENTION

Figure 1:
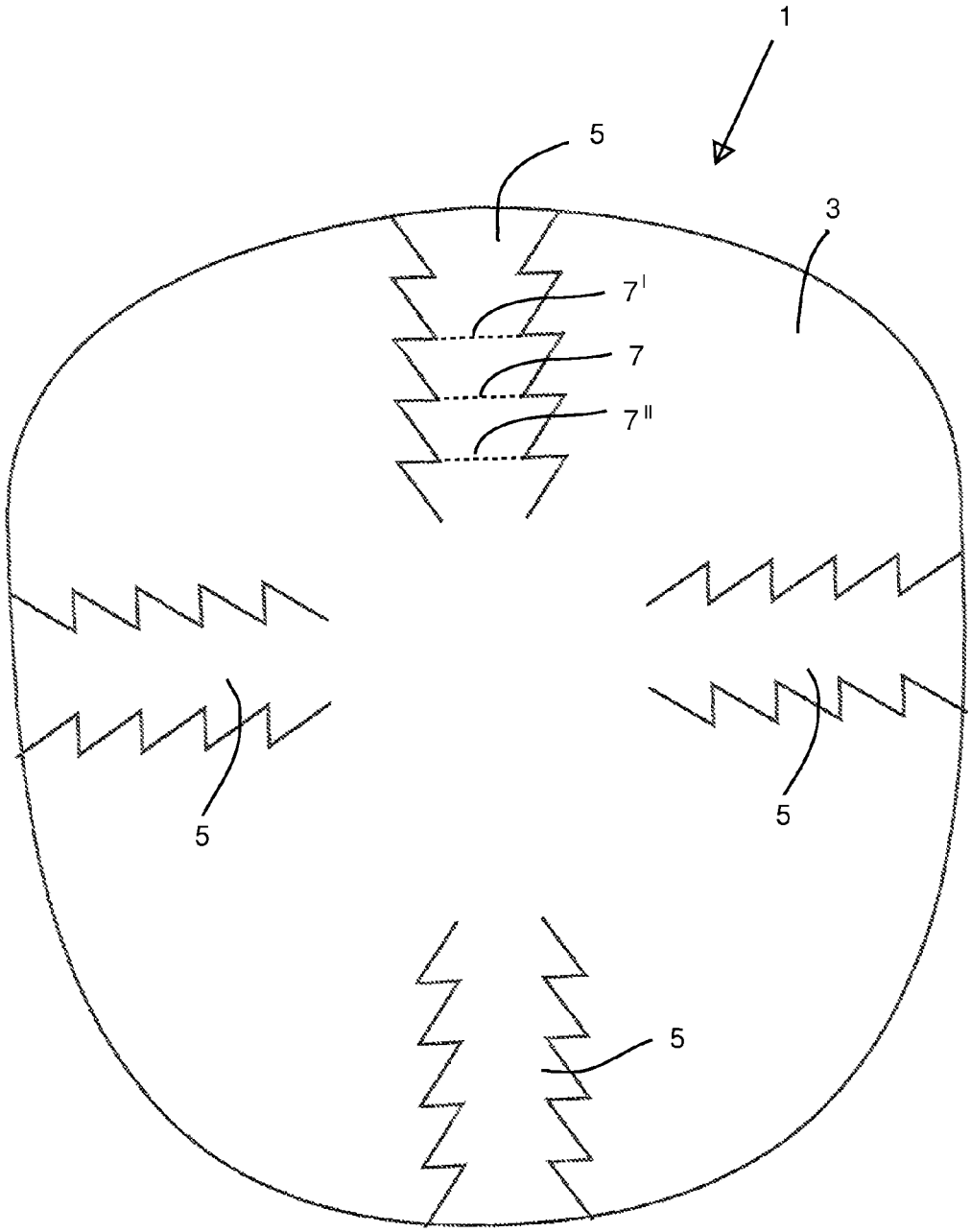
FIG. 1 is a top plan view of a cover element according to the present invention.

In FIG. 1 a cover element 1 according to the invention is shown, which cover element comprises a covering surface 3 and four lips 5 cut or scored into said covering surface.

The serrated shape of the lips 5 ensures that, irrespective of which one of the fold lines 7, 7', 7" illustrated in dotted lines in FIG. 1 is selected, that the lips 5 folded or pressed from the first position, in which position the lips extend substantially parallel to the covering surface, to a second position will have sufficient spring force to make the lips want to return from a second position to a first position.

By providing the various fold lines 7, 7', ", only three of which are shown in FIG. 1, it becomes possible to produce a universal cover element that can be fitted to practically any urinal.

Figure 2:
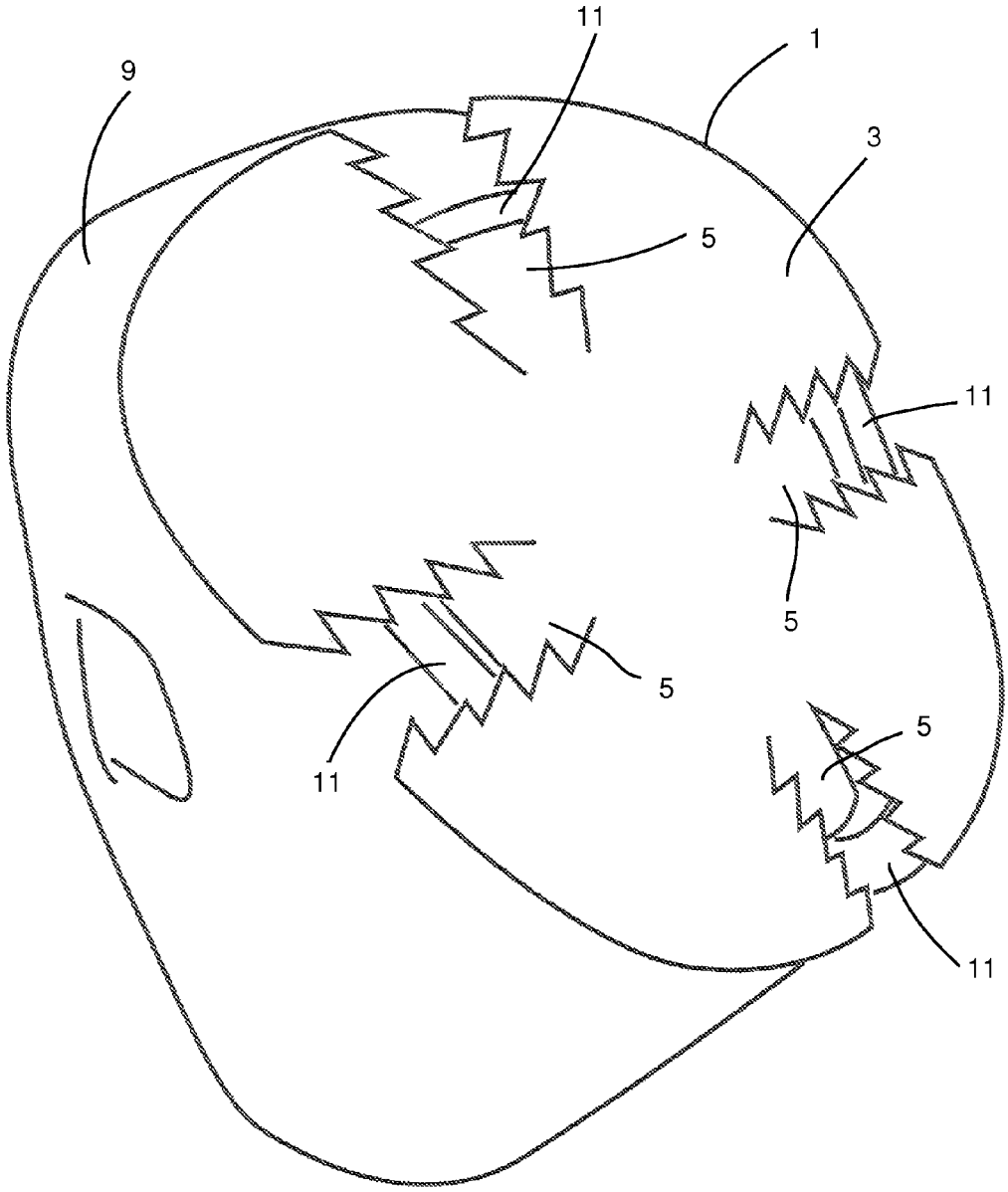
FIG. 2 is a perspective view of a cover element according to the present invention, which is attached to a urinal.

FIG. 2 shows in schematic perspective view how the cover element 1 according to the invention is clamped by means of the lips 5 secured under spring force against an inner side of a urinal edge 11 of a urinal 9. The cover element 1 is relatively easy to attach to a urinal 9 by using a rigid plastic which nevertheless comprises sufficiently elasticity for providing the lips 5 pressed from the covering surface 3 with sufficient spring force, and thus clamping force. Suitable plastics are polypropylene, polyvinyl chloride and polyethylene terephthalate. The use of plastic makes it possible to realise a cover element 1 which can be produced at relatively low cost and which is suitable for single use, which is desirable in the case of urinals for hygienic reasons.

Instead of the lips 5, also other means of attachment can be used, such as the previously discussed projections (not shown) or lips glued or otherwise attached to the covering surface.

The dimensions of the universal cover element 1 are large in relation to those of the largest common urinals, so that the open area of practically any urinal 9 can be substantially completely covered by means of the cover element 1.

The cover element 1 may be provided with text, for example "out of order" or a commercial text printed thereon. The cover element may furthermore be made in a special colour.

With the cover element 1 according to the invention, at least two means of attachment are needed for attaching the cover element to the urinal 9.

The invention claimed is:

1. A cover element for temporarily covering an open area of a urinal bounded by a urinal edge, which area is accessible to a user, the dimension of the cover element being at least such that substantially the entire open area of the urinal can be covered therewith, wherein the cover element comprises at least two lips which can be moved against a spring force from a first position substantially parallel to a covering surface of the cover element to a second secured position in which the lips are positioned in clamping contact against an inner side of the urinal edge, for attaching the cover element over the open area of the urinal.

2. The cover element according to claim 1, wherein the lips are scored into the covering surface.

3. The cover element according to claim 1, wherein the lips are cut into the covering surface.

4. The cover element according to claim 1, wherein a length of a lip is variable.

* * * * *